US010004301B2

(12) United States Patent
Minson

(10) Patent No.: US 10,004,301 B2
(45) Date of Patent: Jun. 26, 2018

(54) BELT BUCKLE

(71) Applicant: John Minson, Sandy, UT (US)

(72) Inventor: John Minson, Sandy, UT (US)

( * ) Notice: Subject to any disclaimer, the term of this patent is extended or adjusted under 35 U.S.C. 154(b) by 181 days.

(21) Appl. No.: 14/601,002

(22) Filed: Jan. 20, 2015

(65) Prior Publication Data

US 2016/0206051 A1 Jul. 21, 2016

(51) Int. Cl.
*A44B 11/04* (2006.01)
*A41F 9/00* (2006.01)

(52) U.S. Cl.
CPC ..... *A44B 11/04* (2013.01); *A41F 9/002* (2013.01)

(58) Field of Classification Search
CPC ..... A44B 11/006; A44B 11/04; A44B 11/001; A44B 11/02; A44B 11/003; Y10T 24/4014; Y10T 24/4088; Y10T 24/4736; A41F 9/002
USPC ..... 2/321, 322; D11/218; 24/198
See application file for complete search history.

(56) References Cited

U.S. PATENT DOCUMENTS 154,270 A * 8/1874 Mullee ..... A41F 9/002 2/300
636,149 A * 10/1899 Kimsey ..... A41F 9/002 2/319
728,206 A 5/1903 Crafts
867,638 A 10/1907 Boyden
1,209,075 A † 12/1916 Thomas
D56,246 S 9/1920 Alterson
1,639,226 A * 8/1927 Haines ..... A41F 1/00 223/103
1,723,841 A * 8/1929 Butler ..... A44B 11/04 24/198
2,133,153 A 10/1938 Shaulson
2,231,259 A 2/1941 Elwell
D134,825 S 1/1943 Petter
2,343,118 A * 2/1944 White ..... A44B 11/04 24/198
2,569,933 A 10/1951 Johnson
3,064,271 A 11/1962 Kuber
3,104,436 A 9/1963 Ostolaza
D214,336 S 6/1969 Petrie
3,555,626 A * 1/1971 Terada ..... A44B 11/04 24/130

(Continued)

*Primary Examiner* — Jack W Lavinder
(74) *Attorney, Agent, or Firm* — Thorpe North & Western, LLP

(57) ABSTRACT

A belt buckle is disclosed and described. The belt buckle can include a support structure defining a front side and a back side of the belt buckle. The belt buckle can also include a first belt strap coupling feature supported by the support structure to couple with a first portion of a belt strap. The first belt strap coupling feature can define a belt strap opening configured to receive the first portion of the belt strap therethrough. In addition, the belt buckle can include a second belt strap coupling feature supported by the support structure to couple with a second portion of the belt strap. The first belt strap coupling feature can be sufficient to bindingly engage the first portion of the belt strap when the belt strap extends in opposite directions on the front side and the back side of the belt buckle to minimize relative movement between the first portion of the belt strap and the first belt strap coupling feature.

15 Claims, 5 Drawing Sheets

(56) References Cited

U.S. PATENT DOCUMENTS

| | | | | |
|---|---|---|---|---|
| 4,077,091 | A * | 3/1978 | Liljedahl | A44B 11/006 2/322 |
| 4,571,783 | A | 2/1986 | Kasai | |
| 5,644,822 | A | 7/1997 | Frew | |
| 6,553,632 | B1 | 4/2003 | Brumpton | |
| D474,713 | S | 5/2003 | Eddy | |
| 7,107,656 | B2 | 9/2006 | Chu | |
| 7,404,753 | B2 | 7/2008 | Cheng | |
| D768,531 | S | 10/2016 | Canty-Golden | |
| 2007/0089277 | A1 | 4/2007 | Bacalso et al. | |

* cited by examiner
† cited by third party

BELT BUCKLE

BACKGROUND

Belts have been widely used to support trousers, weapons, tools, etc. when worn around the waist. Typically, belts have a belt strap to wrap around the waist and a belt buckle to secure the belt strap about the waist. One common type of belt utilizes a belt buckle with a frame and prong, with the prong being rotatable about one end of the frame to engage one of several holes in the belt strap and which is anchored against an opposite end of the frame. Another common type of belt utilizes a friction buckle to engage a belt strap, typically made of nylon webbing.

SUMMARY

A typical belt utilizing a friction buckle has several drawbacks. The belt buckle tends to be fairly bulky, the belt strap is usually permanently attached to the belt buckle, and a free end of the belt is typically visible from the front.

Accordingly, a belt buckle is disclosed herein that can facilitate quick and easy separation from a belt strap, hide or obscure a free end of the belt strap, and can be compact and low profile. The belt buckle can include a support structure defining a front side and a back side of the belt buckle. The belt buckle can also include a first belt strap coupling feature supported by the support structure to couple with a first portion of a belt strap. The first belt strap coupling feature can define a belt strap opening configured to receive the first portion of the belt strap therethrough. In addition, the belt buckle can include a second belt strap coupling feature supported by the support structure to couple with a second portion of the belt strap. The first belt strap coupling feature can be sufficient to bindingly engage the first portion of the belt strap when the belt strap extends in opposite directions on the front side and the back side of the belt buckle to minimize relative movement between the first portion of the belt strap and the first belt strap coupling feature.

In one aspect, a belt is disclosed. The belt can include a belt strap and a belt buckle. The belt buckle can have a support structure defining a front side and a back side of the belt buckle. The belt buckle can also have a first belt strap coupling feature supported by the support structure to couple with a first portion of the belt strap. The first belt strap coupling feature can define a belt strap opening configured to receive the first portion of the belt strap therethrough. In addition, the belt buckle can have a second belt strap coupling feature supported by the support structure to couple with a second portion of the belt strap. The first belt strap coupling feature can be sufficient to bindingly engage the first portion of the belt strap when the belt strap extends in opposite directions on the front side and the back side of the belt buckle to minimize relative movement between the first portion of the belt strap and the first belt strap coupling feature.

In another aspect, a method for facilitating wearing of a belt is disclosed. The method can include providing a belt strap. The method can also include providing a belt buckle having a support structure defining a front side and a back side of the belt buckle, a first belt strap coupling feature supported by the support structure to couple with a first portion of the belt strap, the first belt strap coupling feature defining a belt strap opening configured to receive the first portion of the belt strap therethrough, and a second belt strap coupling feature supported by the support structure to couple with a second portion of the belt strap. In addition, the method can include facilitating binding engagement of the first belt strap coupling feature and the first portion of the belt strap when the belt strap extends in opposite directions on the front side and the back side of the belt buckle to minimize relative movement between the first portion of the belt strap and the first belt strap coupling feature.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
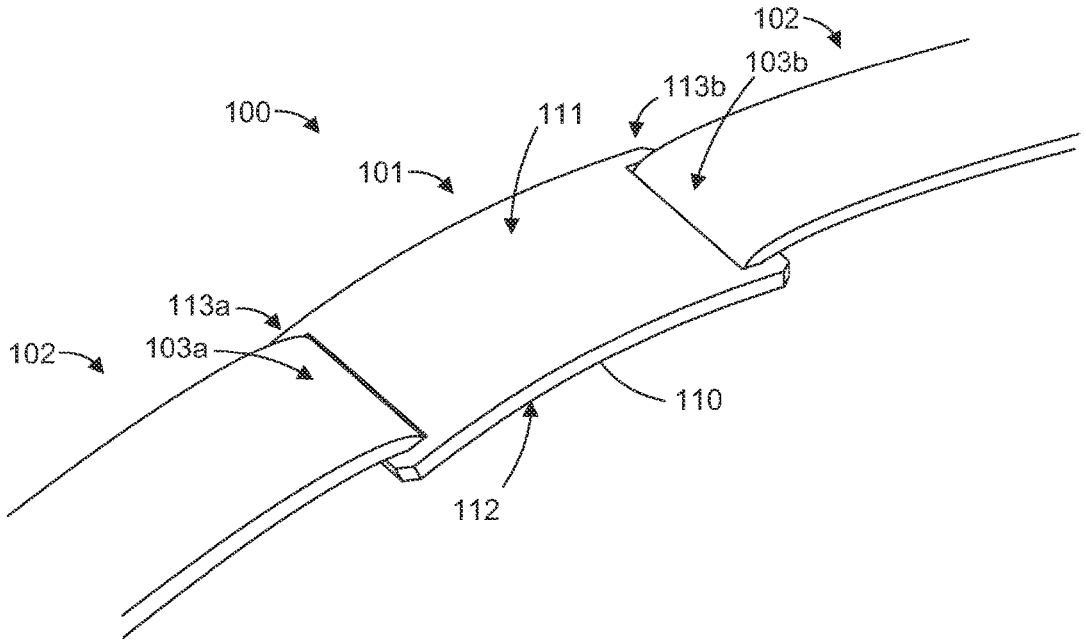
FIG. 1 is a perspective view of a belt having a belt buckle and a belt strap in accordance with an example of the present disclosure.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

DEFINITIONS

In describing and claiming the present invention, the following terminology will be used.

The singular forms "a," "an," and "the" include plural referents unless the context clearly dictates otherwise. Thus, for example, reference to "an edge" includes reference to one or more of such features and reference to "engaging" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of" For example, "at least one of A, B and C" explicitly includes only A, only B, only C, or combinations of each.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Belt Buckle

Figure 2:
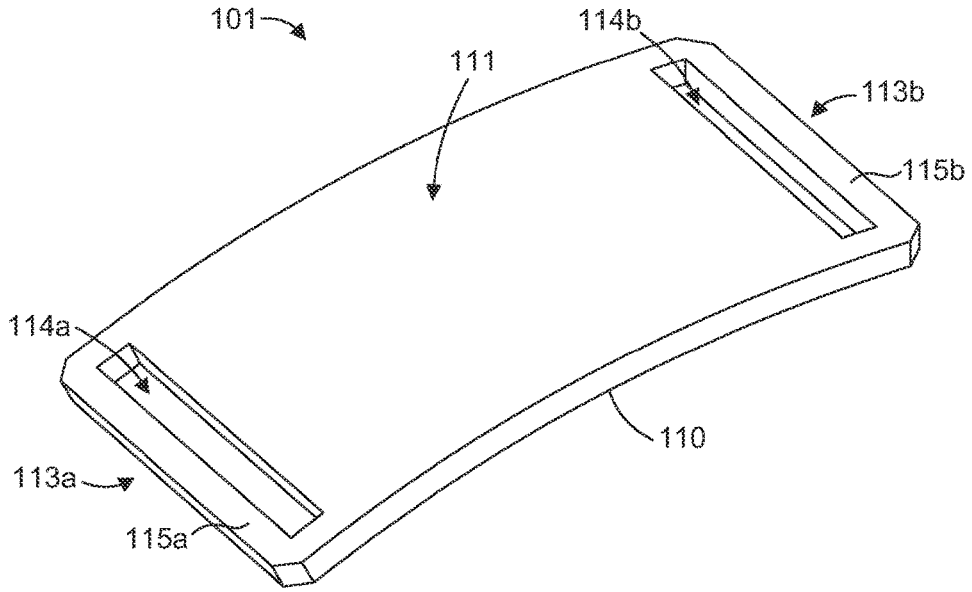
FIG. 2 is the belt buckle of FIG. 1 isolated for clarity.
Figure 3A:
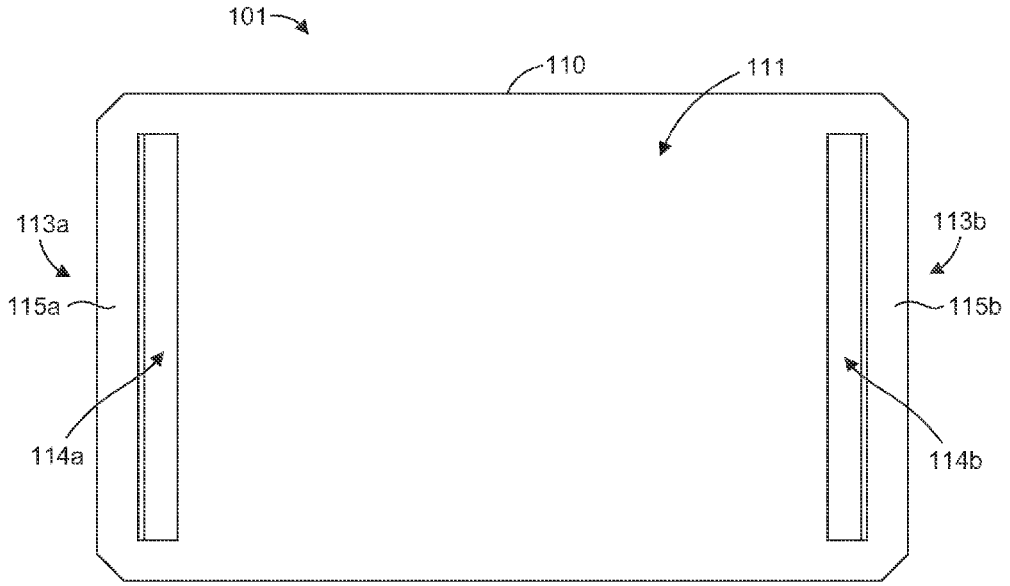
FIG. 3A is a front view of the belt buckle of FIG. 1.
Figure 3B:
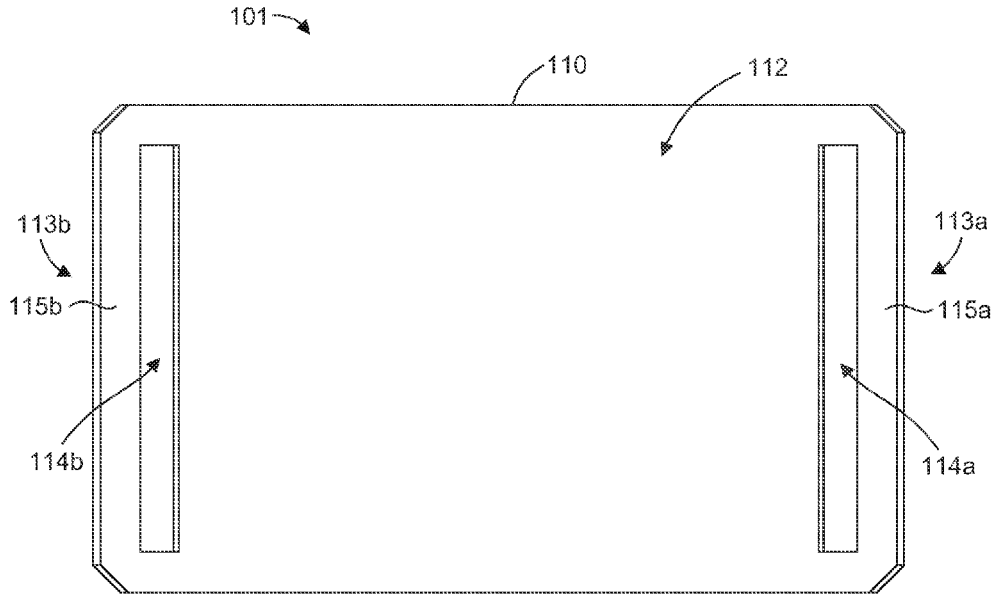
FIG. 3B is a back view of the belt buckle of FIG. 1.
Figure 3C:
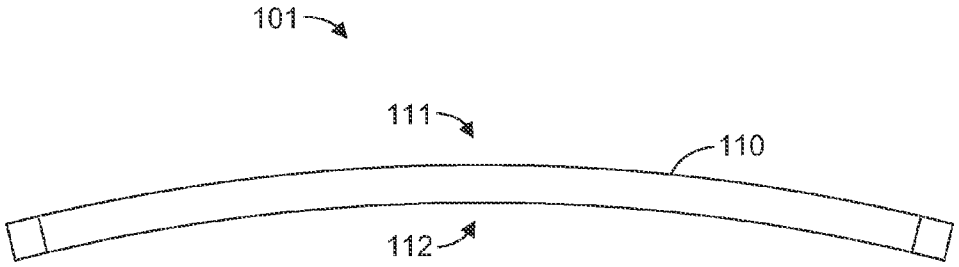
FIG. 3C is a top/bottom view of the belt buckle of FIG. 1.
Figure 3D:
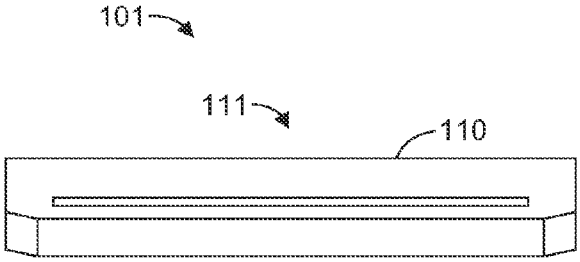
FIG. 3D is a right/left end view of the belt buckle of FIG. 1.
Figure 4:
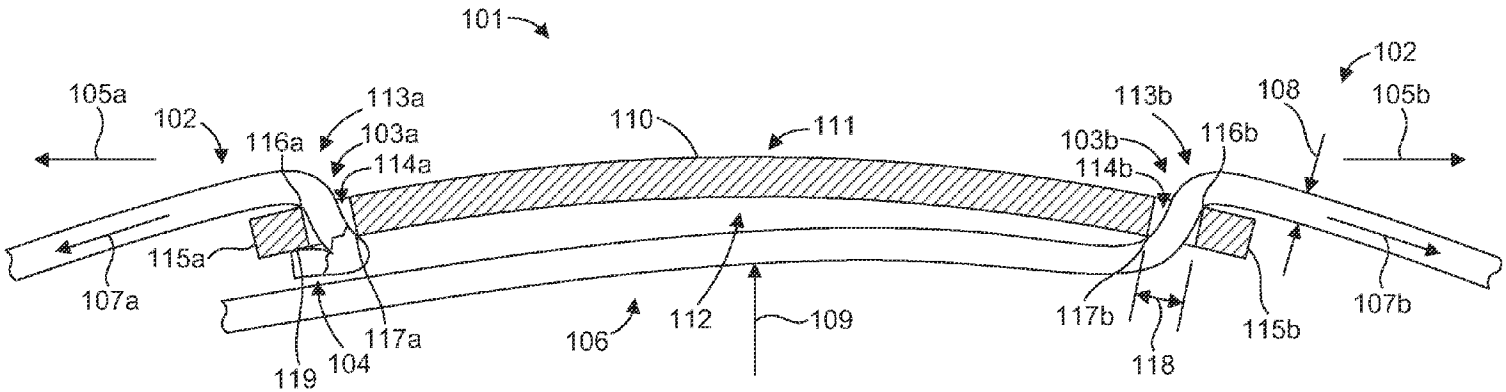
FIG. 4 is a cross-sectional view of the belt of FIG. 1.

With reference to FIG. 1, a belt 100 is illustrated in accordance with an example of the present disclosure. The belt can include a belt buckle 101 and a belt strap 102. The belt strap can be of any suitable type and can be constructed of any suitable belt strap material, such as nylon (i.e., nylon webbing), canvas, cotton, plastic, and/or leather. The belt buckle is shown in FIG. 2 isolated from the belt strap for clarity. FIGS. 3A-3D include front, back, top/bottom, and right/left end views, respectively, of the belt buckle. In addition, FIG. 4 is a cross-sectional view of the belt 100 that illustrates interface and coupling aspects of the belt buckle and belt strap. Each of these aspects is described in more detail below.

Referring generally to FIG. 1, the belt buckle 101 can have a support structure 110 that can define a front side 111 and a back side 112 of the belt buckle. In one aspect, the support structure 110 can comprise a curved plate, which can be formed to fit or approximate the curvature of a body, such as about a waist, to provide a comfortable fit as generally shown in FIG. 3C. A convex side of the curved plate can define the front side 111 of the belt buckle and concave side of the curved plate can define the back side 112 of the belt buckle 101. A thickness of the belt buckle or plate can be of any suitable thickness, such as from about 0.075 inch to about 0.5 inch, although this range in not meant to be limiting. In one aspect, a thickness of the belt buckle can be minimized to provide a low profile belt buckle that is not bulky or heavy and does not bulge from beneath a shirt. The belt buckle can be constructed of any suitable material, such as aluminum, steel, carbon fiber, plastic, wood, composite of these materials, and the like. In one example, the belt buckle can be constructed from a 0.125 inch thick plate of aluminum.

The belt buckle 101 can also include a belt strap coupling feature 113*a*, 113*b* supported by the support structure 110 to couple with the belt strap 102. For example, the belt strap coupling feature 113*a* can be used to couple with a portion 103*a* of the belt strap and the belt strap coupling feature 113*b* can be used to couple with another portion 103*b* of the belt strap. Thus, the belt strap coupling feature 113*a* can be supported at one end of the support structure and the belt strap coupling feature 113*b* can be supported at an opposite end of the support structure, as shown in the figures. As illustrated in FIGS. 2, 3A and 3B, the belt strap coupling feature 113*a*, 113*b* can define a belt strap opening 114*a*, 114*b* configured to receive the corresponding portion 103*a*, 103*b* (FIG. 1) of the belt strap therethrough. Because the belt strap passes through the belt strap openings, the belt strap openings can be in any suitable orientation for the belt strap relative to the belt buckle, although typically the belt strap openings will be parallel to one another. In a particular aspect, the belt strap opening can have a fixed size. For example, a height of the belt strap opening can be configured to accommodate a belt strap of a given width (i.e., a 1.5 inch wide belt strap). A width of the belt strap opening can be configured such that the belt strap coupling feature interfaces appropriately with the belt strap, as described in more detail hereinafter. In another aspect, the belt strap openings 114*a*, 114*b* can at least partially define corresponding ligaments 115*a*, 115*b* at opposing ends of the belt buckle. The belt strap coupling feature 113*a*, 113*b* can be sufficient to bindingly engage the corresponding portion 103*a*, 103*b* (FIG. 1) of the belt strap. In one aspect, the belt strap coupling feature can also include an edge of the belt strap opening configured to bindingly engage the portion of the belt strap.

Thus, for example, as illustrated in FIG. 4, the portion 103*a* of the belt strap 102 can pass over the ligament 115*a* on the front side 111 of the belt buckle 101 and through the belt strap opening 114*a*. An edge 116*a* of the ligament 115*a* about a portion of the belt strap opening 114*a* on the front side can engage the belt strap at one location and an opposite edge 117*a* about a portion of the belt strap opening on the back side 112 can engage the belt strap at another location. In this case, the end of the belt strap has been configured to include a coupling interface feature 104 to facilitate coupling with the belt strap coupling feature 113*a*. The coupling interface feature can include a fold, a crimp, a stud, and/or any other suitable item or feature configured to catch on the belt strap coupling feature 113*a* to facilitate coupling with the belt strap coupling feature. As illustrated, the coupling interface feature includes a fold in the belt strap configured to position the belt strap against the ligament 115*a* at 119. In this case, the portion 103*a* of the belt strap bindingly engages the coupling feature 113*a* with at least three points of contact (i.e., at edges 116*a*, 117*a*, and on the ligament 115*a* at 119). In one aspect, the coupling interface feature can serve to maintain the belt strap in contact with the edges 116*a*, 117*a*, which can provide the primary frictional force to secure the belt strap to the belt coupling feature.

In another aspect, the coupling interface feature can create a structural interference that can prevent the portion 103*a* of the belt strap from being pulled from the belt strap opening 114*a*. Such a coupling interface feature can be associated with a "fixed" end of the belt strap with the buckle to maintain engagement of the belt strap and the belt strap coupling feature 113*a* and prevent slippage of the belt strap within the belt strap opening when subjected to tensioning force 107*a*. It should be recognized that the configuration illustrated in FIG. 4 provides for easy and fast removal of the belt strap from the belt buckle. For example, the fold in the belt strap can be oriented such that the fold fits through the opening and then the belt strap can be pulled through the belt strap opening from the front side of the belt buckle. On the other hand, the belt strap can be pulled through the belt strap opening from the back side of the belt buckle, avoiding interference with the fold in the end of the belt strap.

Although the coupling feature 113*a* in the figures is configured to bindingly engage the belt strap 102, it should be recognized that any suitable type of coupling feature can be utilized for the "fixed" end of the belt strap. For example, the belt strap can be configured to be looped or wrapped around the ligament 115*a* or other such structure and fastened in order to couple the fixed end of the belt strap to the belt buckle 101.

As further illustrated in FIG. 4, the portion 103*b* of the belt strap 102 can pass over the ligament 115*b* on the front side 111 of the belt buckle 101 and through the belt strap opening 114*b*. An edge 116*b* of the ligament 115*b* about a portion of the belt strap opening 114*b* on the front side can engage the belt strap at one location and an opposite edge 117*b* about a portion of the belt strap opening on the back side 112 can engage the belt strap at another location. The belt strap coupling feature 113*b* can be sufficient to bindingly engage the portion 103*b* of the belt strap with two points of contact (i.e., at edges 116*b* and 117*b*) when the belt strap extends in generally opposite lateral directions 105*a*, 105*b* on the back side 112 and the front side 111 of the belt buckle. The binding engagement can minimize relative movement between the belt strap coupling feature 113*b* and the portion 103*b* of the belt strap, thus securing the belt strap to the belt buckle at a point along the belt strap to achieve a desired adjustment of the belt about a person's body, such as the waist. In one aspect, the belt strap coupling feature can secure the belt strap without the belt strap looping around the ligament 115*b* or being directed back on itself. Thus, a single belt strap coupling feature can be sufficient to bindingly engage a "free" or adjustable end or portion of the belt strap.

To achieve and/or aid a binding engagement between the belt strap 102 and the belt strap coupling feature 113*b*, the belt strap can have a relatively tight fit within the belt strap opening 114*b*. For example, a width 118 of the belt strap opening 114*b* and a thickness 108 of the belt strap can be configured to facilitate movement of the belt strap within the belt strap opening while generating friction at the contact edges 116*b*, 117*b* sufficient to prevent slippage of the belt strap within the belt strap opening when a portion 106 of the belt strap is positioned proximate the back side of the buckle, as shown in FIG. 4. In one optional aspect, the belt thickness can be from about 35% to 75% of the belt strap opening width. In one aspect, the portion 106 of the belt strap can be maintained in a position proximate the back side of the buckle by a force 109 exerted against the belt strap. The force 109 can be exerted by the wearer's body, which can be applied as a natural consequence of wearing the belt. The force 109 exerted by the body while wearing the belt can therefore serve to maintain proper positioning of the portion 106 of the belt strap, which can serve to maintain the frictional engagement of the belt strap against the contact edges 116*b*, 117*b* sufficient to prevent slippage of the belt strap when subjected to tensioning force 107*b*. The force 109 exerted by the body against the belt strap can be relatively small compared to the tensioning force 107*b* in the belt strap due to the friction between the contact edges 116*b*, 117*b* and the belt strap. In general, the tighter the fit between the belt strap and the belt strap opening, the more effective positioning the portion 106 of the belt strap proximate the back side of the buckle will be at binding, or generating friction between, the belt strap and the contact edges.

In addition to varying the tightness of the fit of the belt strap 102 within the belt strap opening 114*b*, the friction provided by the contact edges 116*b*, 117*b* can be varied as desired in a variety of ways. For example, the belt strap coupling feature 113*b* can include friction enhancing features, such as a surface texture (e.g., sand blast finish or knurling), protrusions, recesses, etc. In one aspect, these edges (i.e. 116*a*, 117*a*, 116*b*, 117*b*) can be 90 degree straight edges. However, these edges can be serrated, ridged, or otherwise textured to increase frictional engagement with the belt strap. Such friction enhancing features can be associated with a contact edge, a surface about the belt strap opening, a ligament, or any other suitable feature or portion of the belt strap coupling feature that may come into contact with the belt strap during use. In one aspect, such friction may be affected by a decorative feature of the belt buckle, such as a design etched into a surface of the belt buckle 101 or a decorative surface finish. A color application, such as anodization or paint, may also impact the friction provided by the belt buckle to the belt strap. Furthermore, any edge of the belt buckle can include a chamfer, a round, or other suitable edge treatment which may also affect the friction provided by an edge, such as contact edges 116*b*, 117*b*, to the belt strap. Friction provided by the belt buckle for securing the belt strap can therefore be enhanced or diminished to achieve a desired result.

Figure 5:
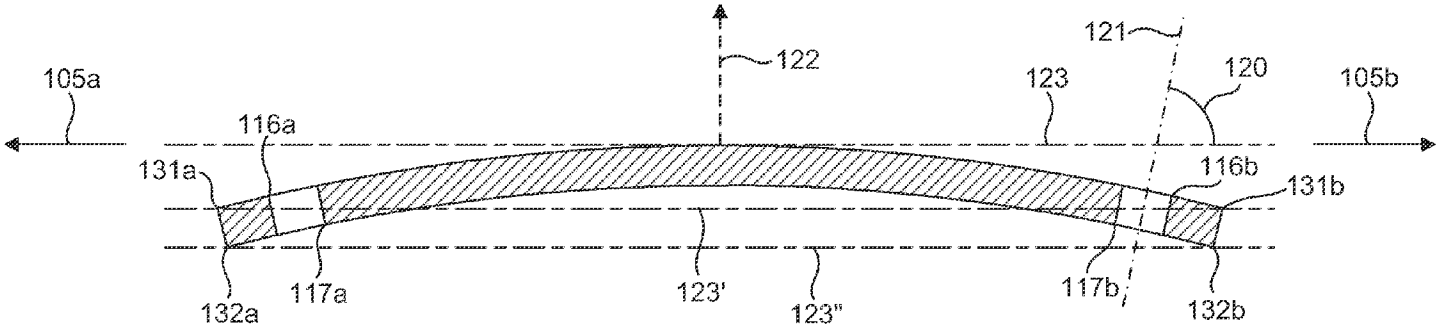
FIG. 5 is a cross-sectional view of the belt buckle of FIG. 1 illustrating an angle for a belt strap opening in accordance with an example of the present disclosure.

In one aspect, as shown in FIG. 5 an angle 120 of the belt strap opening 114*a*, 114*b* relative to the lateral belt strap direction 105*a*, 105*b* of the belt buckle can be varied to affect the friction provided by the contact edges 116*a*, 117*a*, 116*b*, 117*b*. Orientation of the belt strap opening is referenced by a belt strap opening center plane 121. A plane used to establish the later belt strap directions can be defined in several different ways. For example, a line 122 normal to the surface of the belt buckle on the front side can define a plane 123, a plane 123' can intersect opposite front edges 131*a*, 131*b*, and a plane 123" can intersect opposite back edges 132*a*, 132*b*. The lateral belt strap directions can be established using one of these planes. For example, the lateral belt strap directions can be parallel to the plane 123, 123', 123" and perpendicular to a line defined by the intersection of plane 121 and the plane 123, 123', 123", respectively. In one aspect, the angle of the belt strap opening relative to the lateral belt strap direction can be from about 60 degrees to about 120 degrees, although this range is not intended to be limiting.

Figure 6A:
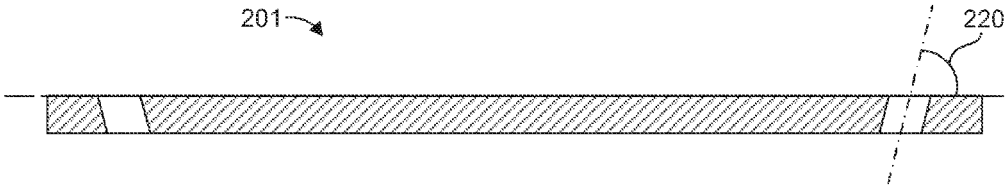
FIG. 6A is a cross-sectional view of a belt buckle in accordance with another example of the present disclosure illustrating an angle for a belt strap opening.
Figure 6B:
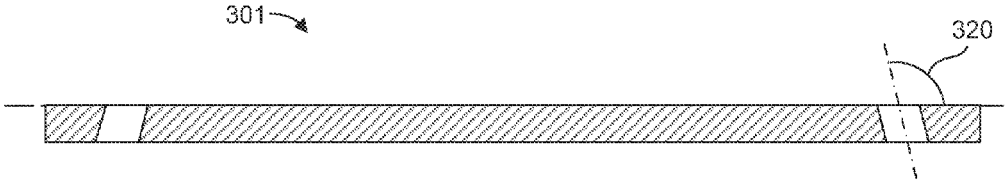
FIG. 6B is a cross-sectional view of a belt buckle in accordance with yet another example of the present disclosure illustrating an angle for a belt strap opening.
Figure 6C:
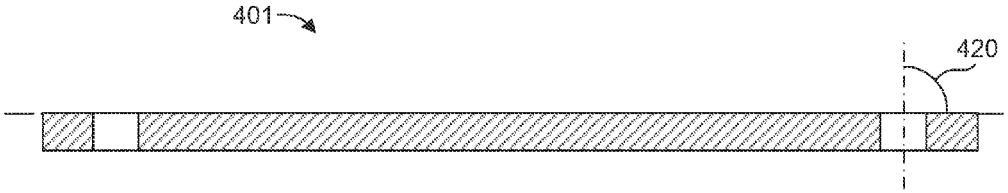
FIG. 6C is a cross-sectional view of a belt buckle in accordance with still another example of the present disclosure illustrating an angle for a belt strap opening.

FIGS. 6A-6C illustrate belt buckles 201, 301, 401 in accordance with several examples of the present disclosure that show various angles of the belt strap opening relative to the lateral belt strap direction of the belt buckle. Each of these belt buckles has a flat or planar configuration. In addition, each of these belt buckles illustrates a different angle of the belt strap opening relative to the lateral belt strap direction of the belt buckle. For example, belt buckle 201 of FIG. 6A illustrates an angle 220 that is less than 90 degrees, belt buckle 301 of FIG. 6B illustrates an angle 320 that is greater than 90 degrees, and belt buckle 401 of FIG. 6C illustrates an angle 420 that is 90 degrees. In one aspect, the angle can be from 45 to 85 degrees. As mentioned above, these angles can be varied to affect the friction provided by the contact edges about the belt strap openings to achieve a desired amount of friction or binding with a belt strap while allowing the belt strap to move within the belt strap openings to facilitate adjustment of the belt tightness. In one aspect, the angles can be varied according to attributes of the belt strap, such as stiffness/compliance, roughness/smoothness, etc. For example, an angle greater than 90 degrees, as illustrated in FIG. 6B, can form a contact edge with an acute angle that can "bite" into the belt strap, which may be useful for a more compliant belt strap. On the other hand, an angle less than 90 degrees, as illustrated in FIG. 6A, can form a contact edge with an obtuse angle that provides less of a "bite" into the belt strap, which may be useful for a relatively stiff belt strap.

In one aspect, a belt buckle in accordance with the present disclosure can be of a single, unitary construction with no moving parts, which can therefore bindingly engage the belt strap without utilizing moving parts. The friction engagement or coupling features can provide for infinite belt adjustment possibilities, as opposed to the limited, discrete adjustment nature of belt holes in a belt strap with a typical frame and prong belt buckle. The belt buckle can also provide a clean, minimal look, which has no unsightly holes or a visibly protruding belt flap. In addition, a belt in accordance with the present disclosure can be constructed of only two parts (a single, unitary belt buckle and a single belt strap), which can simplify manufacturing and keep production costs low.

In one aspect, the belt strap does not need to be permanently connected to the belt buckle or utilize a fastening mechanism to couple with the belt buckle, such as a snap, rivet, or other fastener. Thus, the belt buckle and the belt strap can be quickly and easily removed from one another to facilitate use of a variety of belt buckles with a variety of belt straps. For example, one belt strap can be removed from a belt buckle and replaced with a different belt strap, perhaps of a different color or material. On the other hand, one belt buckle can be removed from a belt strap and replaced with a different belt buckle, perhaps of a different color or shape. Thus, multiple buckles can be used with one or multiple interchangeable belt straps. With such easy and fast assembly/disassembly, it is possible to select from a variety of belt options with several different belt buckles and belt straps to provide a desired look. In a particular aspect, a belt strap can have a different appearance on opposite sides such that the belt strap is "reversible" to provide a different look with the same or a different belt buckle. In another aspect, a belt buckle can be configured to be reversible, such as one utilizing a flat or planar configuration as shown in FIGS. 6A-6C, to reveal a different look on opposite sides of the belt buckle. Belt buckles and belt straps in accordance with the present disclosure can therefore be "mixed and matched" to provide a variety of combinations for a variety of different looks or occasions.

Figure 7:
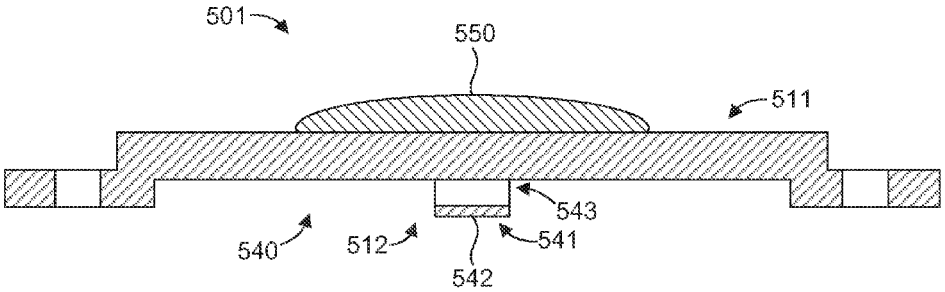
FIG. 7 is a cross-sectional view of a belt buckle in accordance with an additional example of the present disclosure.

FIG. 7 illustrates a belt buckle 501 in accordance with another example of the present disclosure. The belt buckle 501 is similar to the belt buckle 101 in many respects. For example, both the belt buckle 101 and the belt buckle 501 are configured to accommodate the curvature of a body to provide a comfortable fit. Unlike the belt buckle 101, which utilizes the curvature of a curved plate, the belt buckle 501 includes a recess 540 on a back side of the belt buckle to accommodate the curvature of a wearer's body.

The belt buckle 501 also includes a belt strap guide 541 operable to hold a portion of the belt strap proximate to the back side of the belt buckle. Although force provided by the wearer's body may be sufficient to maintain the binding engagement of a belt strap coupling feature with a belt strap, as described above, the belt strap guide can provide a structure to ensure that the belt strap is kept in a proper position to maintain adequate friction between the belt strap and the belt strap coupling feature. For example, the belt strap guide can include a guide portion 542 that defines an opening 543 configured to receive the belt strap. Once the belt strap is extending through the opening, the guide portion can provide a barrier to movement of the belt strap away from the back of the belt buckle that would tend to lessen the frictional engagement of the belt strap and the belt strap coupling feature. The belt strap guide can be coupled to the support structure in any suitable manner. In one aspect, the belt strap guide can be integrally formed with the support structure.

In addition, the belt buckle 501 includes a decorative feature 550 disposed on a front side 511 of the belt buckle. The decorative feature can be of any suitable size or configuration. In one aspect, the decorative feature can comprise a gemstone, an engraving, a casting, etc. The decorative feature can be coupled to the support structure in any suitable manner.

In accordance with one example of the present disclosure, a method for facilitating wearing of a belt is disclosed. The method can comprise providing a belt strap. The method can also comprise providing a belt buckle having a support structure defining a front side and a back side of the belt buckle, a first belt strap coupling feature supported by the support structure to couple with a first portion of the belt strap, the first belt strap coupling feature defining a belt strap opening configured to receive the first portion of the belt strap therethrough, and a second belt strap coupling feature supported by the support structure to couple with a second portion of the belt strap. Additionally, the method can comprise facilitating binding engagement of the first belt strap coupling feature and the first portion of the belt strap when the belt strap extends in opposite directions on the front side and the back side of the belt buckle to minimize relative movement between the first portion of the belt strap and the first belt strap coupling feature. It is noted that no specific order is required in this method, though generally in one embodiment, these method steps can be carried out sequentially.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A belt, comprising:

a belt strap having a free end extending from a first portion of the belt strap, and a fixed end defined by a coupling interface feature associated with a second portion of the belt strap; and a belt buckle coupled to the belt strap, the belt buckle having a support structure defining a rectangular-shaped front side and a back side of the belt buckle, a first belt strap coupling feature supported by the support structure coupleable with the first portion of the belt strap, the first belt strap coupling feature consisting of a single first rectangular-shaped belt strap opening for receiving only the first portion of the belt strap therethrough, and a second belt strap coupling feature supported by the support structure coupled with the second portion of the belt strap, the second belt strap coupling feature consisting of a single second rectangular-shaped belt strap opening receiving only the second portion of the belt strap therethrough, the coupling interface feature structurally interfering with the second belt strap coupling feature and preventing the second portion of the belt strap from being pulled from the second belt strap opening thereby locating the fixed end of the belt strap at the second belt strap coupling feature, the second portion of the belt strap extending away from the belt buckle at the second belt strap coupling feature, wherein the first belt strap coupling feature is operable to bindingly engage the first portion of the belt strap as the belt strap extends in opposite lateral belt strap directions on the front side and the back side of the belt buckle and minimize relative movement between the first portion of the belt strap and the first belt strap coupling feature, the first portion of the belt strap extending away from the belt buckle at the first belt strap coupling feature, and wherein the free end of the belt strap is positionable immediately adjacent to the back side of the belt buckle without extending through the second belt strap opening when the first portion of the belt strap is engaged with the first belt strap coupling feature.

2. The belt of claim 1, wherein the belt strap opening has a fixed size.

3. The belt of claim 1, wherein the first belt strap coupling feature is supported at a first end of the support structure and the second belt strap coupling feature is supported at a second end of the support structure opposite the first end.

4. The belt of claim 1, wherein the coupling interface feature comprises a fold, a crimp, a stud, or combinations thereof configured to catch on and structurally interfere with the second belt strap coupling feature.

5. The belt of claim 1, wherein the first belt strap coupling feature comprises an edge of the belt strap opening bindingly engaging the first portion of the belt strap.

6. The belt of claim 1, wherein the second belt strap coupling feature comprises an edge of the second belt strap opening bindingly engaging the second portion of the belt strap.

7. The belt of claim 1, wherein the first and second belt strap openings are parallel to one another and oriented transverse to the lateral belt strap directions.

8. The belt of claim 1, wherein the support structure comprises a curved plate.

9. The belt of claim 8, wherein the back side of the belt buckle is concave.

10. The belt of claim 1, wherein the belt strap comprises a nylon material, a leather material, or combinations thereof.

11. The belt of claim 1, wherein a thickness of the coupling interface feature is greater than a thickness of the belt strap.

12. The belt of claim 1, wherein the coupling interface feature is located immediately adjacent to the back side of the belt buckle.

13. The belt of claim 1, wherein an angle of the belt strap opening is from about 60 degrees to about 120 degrees relative to the lateral belt strap directions.

14. The belt of claim 1, further comprising a belt strap guide located in a direction toward a center of the support structure relative to the first belt strap coupling feature and operable to hold a portion of the belt strap proximate to the back side of the belt buckle to maintain the binding engagement of the first belt strap coupling feature with the first portion of the belt strap.

15. A method for facilitating wearing of a belt, comprising:

providing a belt strap having a free end extending from a first portion of the belt strap, and a fixed end defined by a coupling interface feature associated with a second portion of the belt strap;

providing a belt buckle having a support structure defining a rectangular-shaped front side and a back side of the belt buckle, a first belt strap coupling feature supported by the support structure to couple with the first portion of the belt strap, the first belt strap coupling feature consisting of a single first rectangular-shaped belt strap opening configured to receive only the first portion of the belt strap therethrough, and a second belt strap coupling feature supported by the support structure to couple with the second portion of the belt strap, the second belt strap coupling feature consisting of a single second rectangular-shaped belt strap opening configured to receive only the second portion of the belt strap therethrough, the coupling interface feature structurally interfering with the second belt strap coupling feature and preventing the second portion of the belt strap from being pulled from the second belt strap opening thereby locating the fixed end of the belt strap at the second belt strap coupling feature, the second portion of the belt strap extending away from the belt buckle at the second belt strap coupling feature; and facilitating binding engagement of the first belt strap coupling feature and the first portion of the belt strap when the belt strap extends in opposite lateral belt strap directions on the front side and the back side of the belt buckle to minimize relative movement between the first portion of the belt strap and the first belt strap coupling feature, the first portion of the belt strap extending away from the belt buckle at the first belt strap coupling feature, and wherein a free end of the belt strap is positioned immediately adjacent to the back side of the belt buckle without extending through the second belt strap opening when the first portion of the belt strap is engaged with the first belt strap coupling feature.

* * * * *